United States Patent [19]

Simons

[11] 3,931,626

[45] Jan. 6, 1976

[54] STAGGERED TUNED TV RECEIVING ANTENNA WITH INTEGRATED UHF-VHF SECTIONS

[76] Inventor: Sylvan Simons, 45 Brick Oven Road, Port Chester, N.Y. 10573

[22] Filed: Dec. 7, 1973

[21] Appl. No.: 422,749

[52] U.S. Cl. ..... 343/815; 343/816; 343/812

[51] Int. Cl.[2] ..... H01Q 21/08

[58] Field of Search ..... 343/812–815, 343/816

[56] References Cited

UNITED STATES PATENTS

| | | | |
|---|---|---|---|
| 2,980,912 | 4/1961 | Anderson | 343/815 |
| 3,534,369 | 10/1970 | Rea | 343/815 |
| 3,573,841 | 4/1971 | Greenberg | 343/815 |
| 3,599,217 | 8/1971 | Grant | 343/815 |
| 3,710,337 | 1/1973 | Grant | 343/815 |

*Primary Examiner*—Eli Lieberman
*Attorney, Agent, or Firm*—Alfred E. Miller

[57] ABSTRACT

A TV antenna having integrated UHF-VHF sections and designed to favorably respond to at least two widely spaced frequencies. The dipoles of the antenna are arranged in a staggered tuned array mounted on a pair of conductive cross-arms. The rearmost dipole is provided with a paddle-shaped dipole that can be adjusted for ½ wavelength response at the lower of the two frequencies by varying the perimeter of the paddle, and the higher frequency is tuned in by adjusting the 3/2 wavelength response by varying the length of the inboard conductor.

6 Claims, 3 Drawing Figures

STAGGERED TUNED TV RECEIVING ANTENNA WITH INTEGRATED UHF-VHF SECTIONS

An object of the present invention is the provision of a co-planar array constituting a staggered, tuned antenna with the rearmost dipole being provided with one structural arrangement that is adjusted for best performance on widely spaced TV channels.

A further object of the present invention is to provide means to increase the response of the rear dipoles of a plurality of dipoles of the antenna array at the high VHF band.

Another object of the present invention is to enhance TV reception on the high TV band by means of the use of Franklin-type dipole directors arranged in front of the foremost elements connected to the conductive cross-arm.

A further object of the present invention is to provide a paddle-type dipole for the rearmost dipole which is adjusted for two widely separated frequencies on the high VHF band.

An object of the present invention is to provide a short ¼ wavelength dipole connected to the inboard side of the dipole and extending in the opposite direction thereto.

Another object of the present invention is to provide a short parasitic dipole in close proximity to a low frequency dipole, the latter being the third rearmost dipole of the array.

The invention will now be more fully described with reference to the accompanying drawings, in which.

DESCRIPTION OF THE PREFERRED EMBODIMENTS

Figure 1:
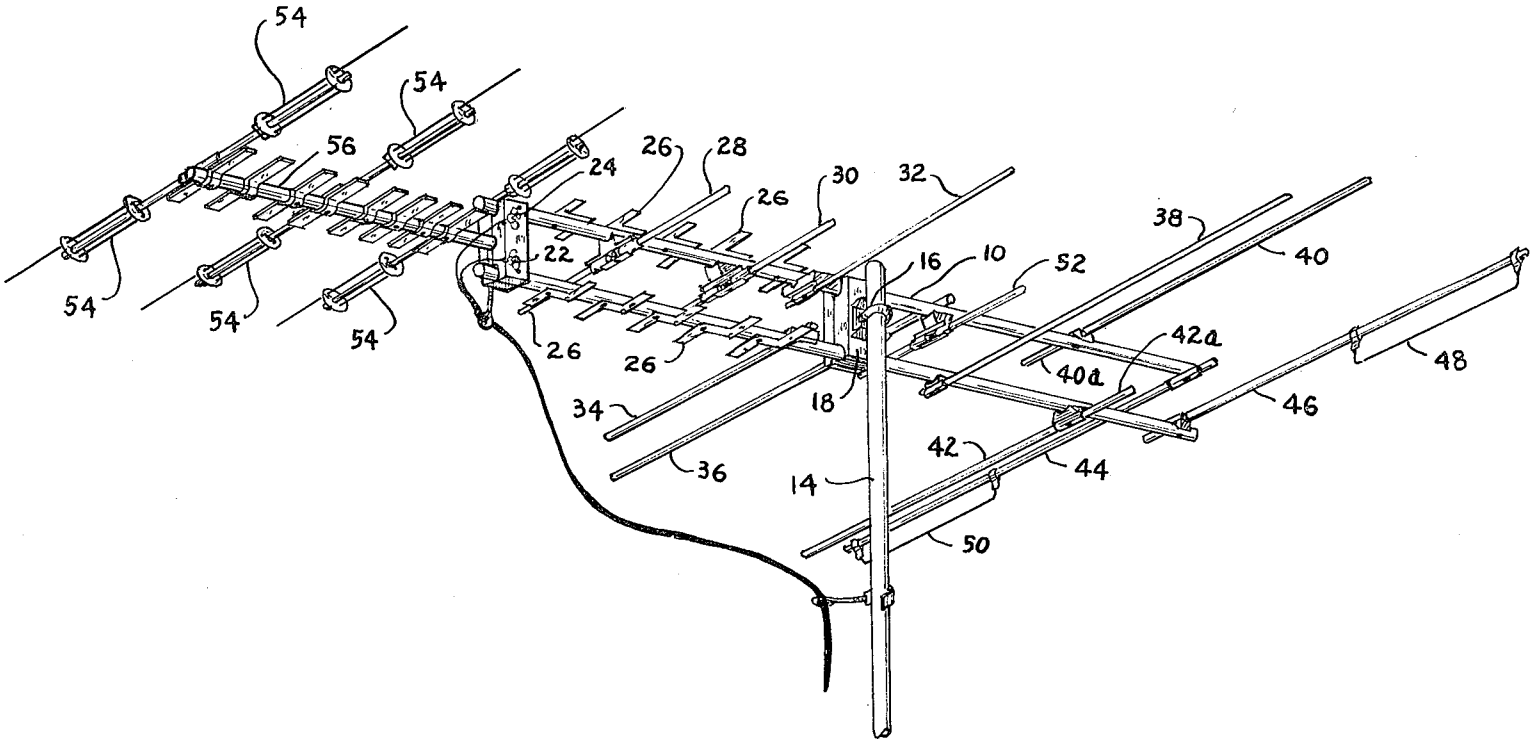
FIG. 1 is a perspective view of an antenna array embodying a dual band antenna utilizing paddle-type dipoles.

Referring to FIG. 1, a dual band antenna array is shown comprising a pair of upper and lower conductive cross-arms 10 and 12 being mounted on a mast 14 by means of a conventional U-bolt 16 and saddle 18. A feed line 20 is connected to the conductive cross-arms at posts 22 and 24, respectively, forward of the UHF section of the antenna array. A plurality of UHF elements as well as axially disposed VHF dipole elements are connected to the feed line 20. In this regard, a plurality of Z-shaped UHF elements 26 are mounted on both the upper and lower conductive cross-arms. The Z-shaped elements are progressively larger from front to rear on both cross-arms and a rigid integrated structure is formed. A pair of spaced short parasitic dipoles 28 and 30, respectively, are illustrated as being mounted in an insulated fashion suspended from the conductive cross-arm 10.

A plurality of dipoles operating in the VHF band is arranged on the antenna array in an increasing length rearwardly and in which adjacent dipoles extend in opposite directions. The dipoles from front to rear bear reference numerals 32, 34, 36, 38, 40, 42, 44, and 46, respectively.

The rearmost dipoles 44 and 46 are provided additionally with paddle-shaped dipoles 48 and 50, respectively, whereby the dipoles 44 and 46 constitute inboard conductors and dipoles 48 and 50 are shaped conducting wires outlining a paddle and fastened to extensions of dipoles 44 and 46. The present antenna may be made to respond to two widely separated frequencies by means of the unique paddle-type dipoles 48 and 50 that are selected for ½ wavelength response at the lower of the two frequencies by varying the perimeter of each of the paddles, while the response at the higher of the two frequencies is selected for 3/2 wavelength operation by adjusting the length of conductors 44 and 46 and the setting the same at a predetermined length.

The dipoles 40 and 42 are provided with short ¼ wavelength dipoles 40*a* and 42*a*, respectively, which are connected to the inboard ends of the dipoles 40 and 42. This construction results in the increased response of these dipoles in the high VHF band.

A short parasitic dipole 52 is shown hung from the cross-arm 10 and in close proximity to the low frequency dipole.

A Franklin-type director array is shown mounted in front of the antenna array that includes a plurality of looped dipoles 54 that are spaced along the forwardly extended mounting arm 56. This director assembly enhances the high band performance of the present antenna array.

Each of the rearmost paddle-type dipoles preferably have the following dimensions:

| | | |
|---|---|---|
| Inboard conductor | 19½ | inches |
| Length of paddle dipole | 25 | inches |
| Connecting piece perpendicular to the paddle dipoles | 3 | inches |

Figure 2:
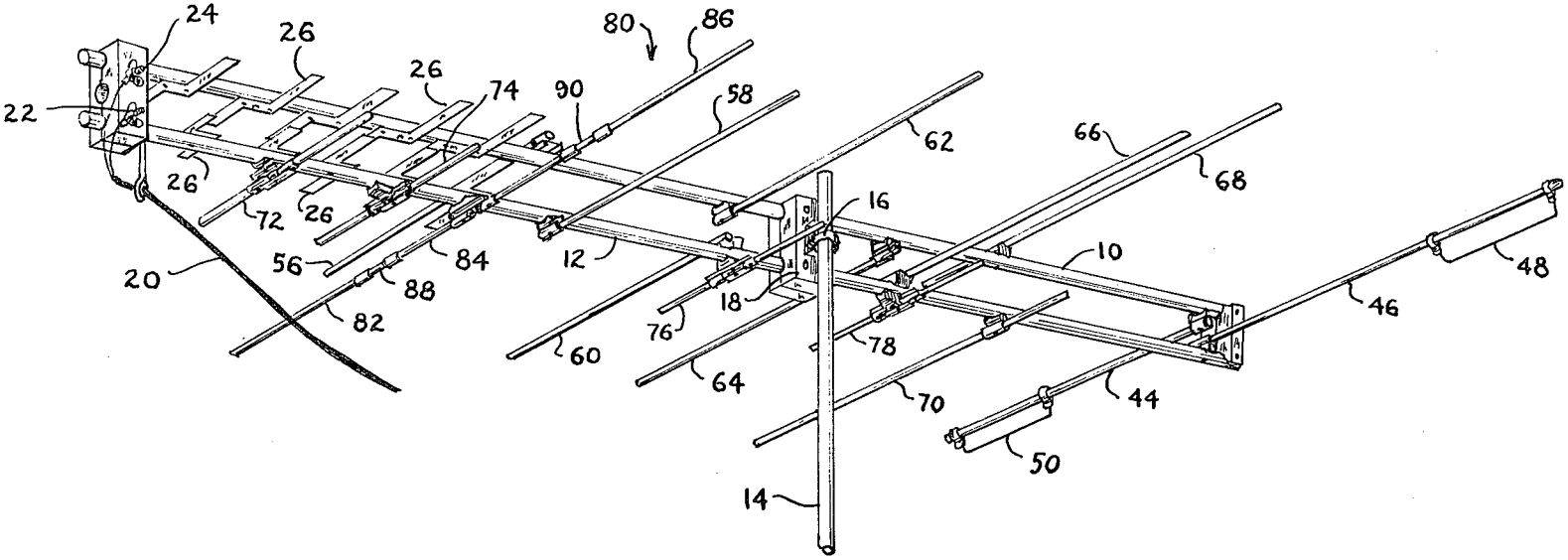
FIG. 2 is a perspective view of an alternate construction of the antenna array embodying the teachings of the present invention and incorporating Franklin-type directors in front of the forwardmost elements of the antenna.

Referring now to FIG. 2 in which like parts to those shown in FIG. 1 bear the same reference numerals, the conductive cross-arms 10 and 12 mount the UHF section forward of the VHF section in the manner shown in FIG. 1. The Z-shaped UHF elements 26 are illustrated, and a feed line 22 is shown connecting forward thereof. The active element dipoles in the VHF section bear the reference numerals 56, 58, 60, 62, 64, 66, 68, and 70. The short parasitic dipoles in the array are 72, 74, 76, and 78, respectively. It will be noted that there is no Franklin-type director system arranged forward of the forwardmost element of this embodiment of the present antenna. Instead, a co-linear director is shown which is referred to generally by the reference numeral 80 and constitutes three axially aligned director dipoles 82, 84, and 86, separated by insulating elements 88 and 90. The advantage of utilizing a co-linear director in the structure shown in FIG. 2 is that the parasitic element may be arranged in close proximity to the driven element without being supported thereby and mechanically weakening the driven element.

Figure 3:
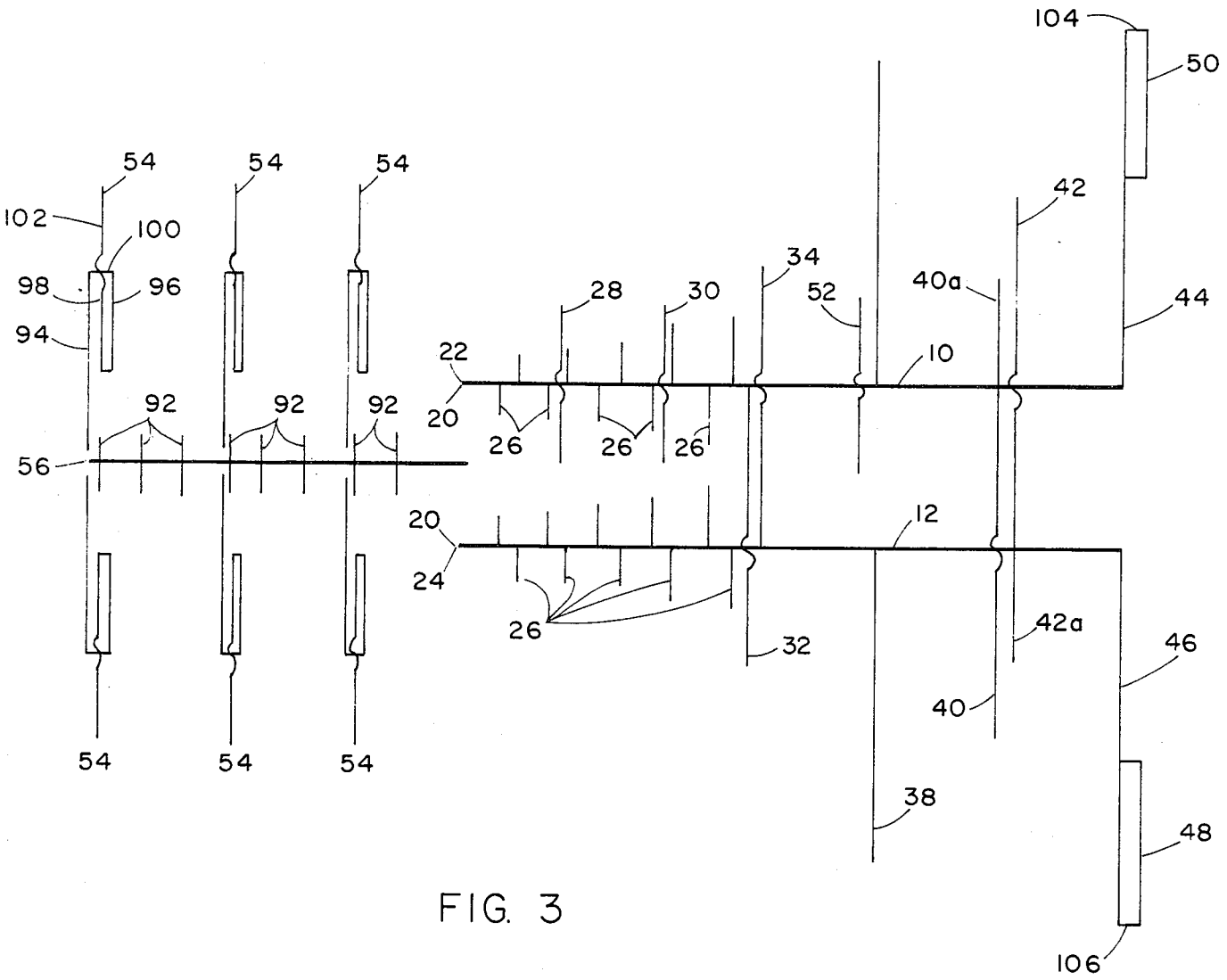
FIG. 3 is a schematic view of the antenna shown in FIG. 1.

Referring to FIG. 3, five Z-shaped UHF elements 26 are shown supported by and connected to each of the conducting cross arms 10 and 12. Each Z-shaped UHF element comprising two cross-phased conductors, with the cross phasing being accomplished by space time phasing the element conductors. The length of each succeeding Z-shaped element conductor increasing with further distance from the lead-in connections 22 and 24 at which point the lead-in wire 20 is fastened. The shortest and closest Z-shaped element conductor to the lead-in connections 22 and 24 is made of a length suitable for maximum response at the highest UHF signal to be received and the one furthest removed from the lead-in connections is made longest for maximum response at the lowest frequency UHF signal to be received.

The low band VHF element conductor pairs 32 and 34, 36 and 38, 40 and 42, 44 and 46, the latter pair with paddleshaped dipoles 48 and 50, are all connected to the conductive cross arms 10 and 12. The extension conductors 40*a* and 40*b* of conductors 40 and 42 are of a length so as to respond to the highest frequency in the high TV band to be received. The parasitic directors 28, 30, and 52 respond to signals in the high TV band and reinforce signals received at those frequencies as do the Franklin type directors 54 supported by but not connected to cross arm 56. Cross arm 56 is insulated from and not connected to cross arms 10 and 12 but is supported by it. UHF parasitic directors 92 reinforce signal at UHF frequencies.

The preferred dimensions of an antenna shown in FIG. 3 are as follows:

| | |
|---|---|
| Franklin dipole section 94 | — 18 inches |
| Franklin dipole section 96 | — 10 inches |
| Franklin dipole section 98 | — 10 inches |
| Franklin dipole section 102 | — 9 inches |
| Connector 100 | — 2 inches |

Each of the three pairs of Franklin directors is fastened to the top of cross arm 56 at the same point but the top side of the UHF director 92 is shown closest to it. The distance between each of the eight UHF directors 92 is 4 inches.

Each of the ten UHF Z-shaped elements are composed of two cross-phased conductor elements. Five Z-shaped elements 26 are used on each cross arm. Since each Z-shaped element consists of two element conductors, a total of ten UHF conductor elements are mounted on each cross arm 10 and 12. UHF conductor lengths beginning with one closest to the lead-in wire connections 22 and 24 and extending rearward toward paddle dipoles are 3 inches, 3¼ inches, 3½ inches, 3¾ inches, 4 inches, 4¼ inches, 4½ inches, 5 inches, 5½ inches, 6 inches, 6½ inches. Each of the Z-shaped elements have a space of 2¾ inches between conductors, or in other words the parallel legs of the Z, are spaced two inches on centers. The high band VHF directors 28 and 30 are supported by an insulating bracket and mounted at same point but the bottom side from Z-shaped element 26 as shown on cross arm 10.

The high band VHF director 52 is riveted to the same point but at the bottom side of cross arm 10 of conductor 36. The distance from lead-in connection 22 to adjacent UHF director 92 is four inches.

The low band VHF conductor elements 32, 36, 42, and 50 and opposite numbers 34, 38, 40, and 46 are spaced 12 inches from each other.

The low band VHF conductor elements 32 and 34 are spaced 3½ inches from adjacent UHF Z-shaped conductor 26.

The preferred lengths of the VHF element conductors are as follows: 32 and 34, – 28 inches; 36 and 38, – 36 inches; 40 and 42, – 40 inches; 40*a* and 42*a*, – 12 inches; inboard conductors 44 and 46, – 19½ inches; paddle dipole conductors 48 and 50, – 25 inches; and connectors 104 and 106, – 3 inches.

What is claimed is:

1. A multi-element VHF television receiving antenna capable of responding to two widely separated frequencies of a frequency range of approximately 3 to 1 comprising two parallel cross-arms, a plurality of cross-phased axially spaced dipoles secured to said cross-arms, at least one of said dipoles having inboard conductors and electrically connected paddleshaped conductors in which the perimeter of the paddle is selected for ½ wavelength response at the lower of said two widely spaced frequencies, and the length of the inboard conductors for the combination of the conductors being selected so that the impedance of the combination of the inboard conductors and the paddle-shaped conductors will make it resonant for approximately 3/2 wavelength at the higher of the two frequencies.

2. The antenna as claimed in claim 1 further comprising means to increase the response of the three rearmost dipoles of the antenna array on the high VHF band including short ¼ wavelength conductors connected to the inboard side of a low VHF band dipole and extending in the opposite direction thereto, a short parasitic dipole in close proximity to a low frequency dipole, and a paddle-shaped conductor connected to the outboard end of a less than ¼ wavelength conductor at the high VHF television band.

3. The antenna as claimed in claim 2 wherein said paddle-type conductor is the rearmost dipole, said short ¼ wavelength conductor connected to the inboard side of the low VHF band dipole and extending in the opposite direction thereto is the second rearmost dipole, and a short parasitic dipole in close proximity to said low frequency dipole being said third rearmost dipole.

4. The antenna as claimed in claim 1 further comprising means for enhancing the high band VHF TV reception, said means including a plurality of passive Franklin-type dipole directors mounted in front of the forwardmost elements on said conductive cross-arms.

5. The antenna as claimed in claim 3 further comprising means for enhancing the high band VHF TV reception, said means including a plurality of Franklin-type dipole directors mounted in front of the forwardmost elements.

6. The antenna as claimed in claim 1 wherein said paddle has a length of approximately 25 inches and said inboard conductor has a length of approximately 19½ inches.

* * * * *